US006373477B1

(12) United States Patent
Van Dijk

(10) Patent No.: US 6,373,477 B1
(45) **Date of Patent: *Apr. 16, 2002**

(54) DISPLAY DRIVING

(75) Inventor: Roy Van Dijk, Eindhoven (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/273,937

(22) Filed: Mar. 22, 1999

(30) Foreign Application Priority Data

Mar. 23, 1998 (EP) ..... 98200918

(51) Int. Cl.[7] ..... G09G 5/00
(52) U.S. Cl. ..... 345/204; 345/3.2; 345/60
(58) Field of Search ..... 345/60, 63, 204, 345/37, 41, 3.2

(56) References Cited

U.S. PATENT DOCUMENTS 5,604,856 A * 2/1997 Guenter ..... 395/173
5,894,333 A * 4/1999 Kanda et al. ..... 348/597
6,052,112 A * 4/2000 Tanaka et al. ..... 345/147
6,067,060 A * 5/2000 Benoit et al. ..... 345/60
6,072,448 A * 6/2000 Kojima et al. ..... 345/60
6,094,243 A * 7/2000 Yasunishi ..... 349/33
6,097,358 A * 8/2000 Hirakawa et al. ..... 345/63
6,124,849 A * 9/2000 Ito et al. ..... 345/60
6,127,992 A * 10/2000 Sano ..... 345/60
6,151,000 A * 11/2000 Ohtaka et al. ..... 345/63

OTHER PUBLICATIONS

Improvement in PDP Picture Quality by Three–Dimensional Scattering of Dynamic False Countours by T. Yamaguchi et al., in SID Digest vol. 96, pp. 291–294.
"Appearance of False Pixels and Degradation of Picture Quallity in Matrix Displays Having Extended Light–Emission Periods" by S. Mikoshiba et al. In SID Digest vol. 92, pp. 659–662.
"Dynamic False Countours on PDPs fatal or Curable?" by Shigeo Mikoshiba in IDW vol. 96 pp. 251–254.
Degradation of moving–image quality in PDPs: Dynamic Fals Contours by Takahiro Yamaguchi et al., in Journal of the SID, vol. 4/4, 1996, pp. 263–270.
New category Contour Noise Observed in Pulse–width–modulated Moving Images by T. Masuda et al., pp. 357–360.

* cited by examiner

*Primary Examiner*—Richard Hjerpe
*Assistant Examiner*—Kimnhung Nguyen
(74) *Attorney, Agent, or Firm*—Edward W. Goodman

(57) ABSTRACT

In a method of driving a display (D), field information from a field of an image signal is distributed (DD) over a plurality of sub-fields, and a start time for each sub-field is generated (AU, SOC) in dependence upon motion.

8 Claims, 9 Drawing Sheets

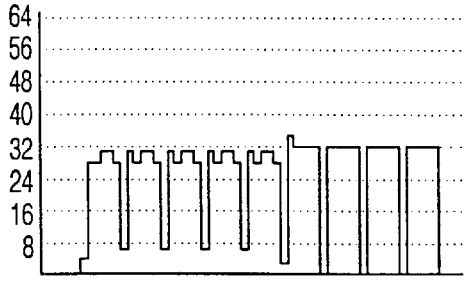
FIG. 6A
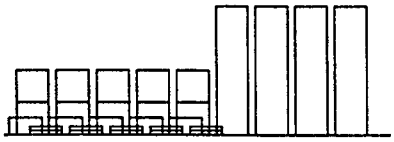
FIG. 6B
FIG. 6C
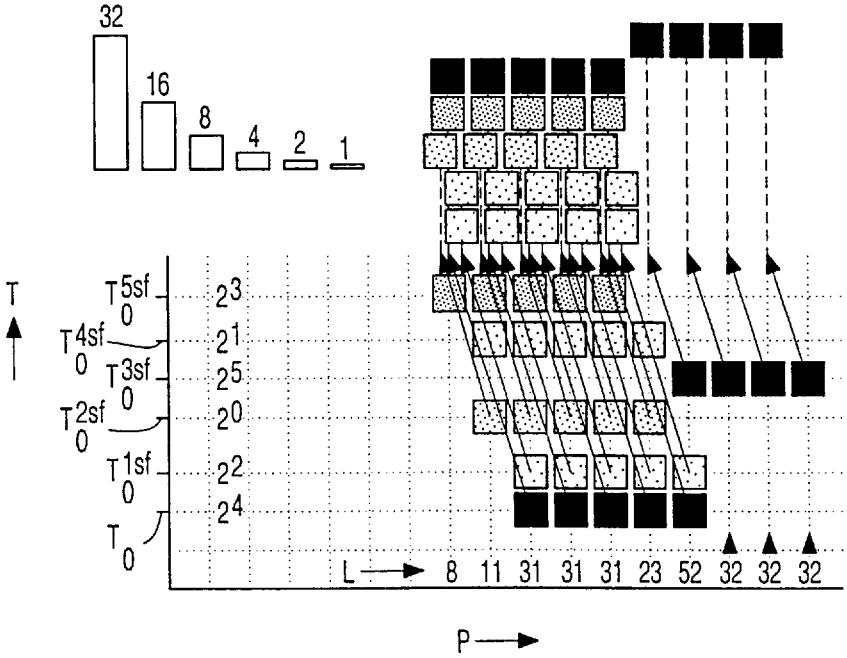
FIG. 6D

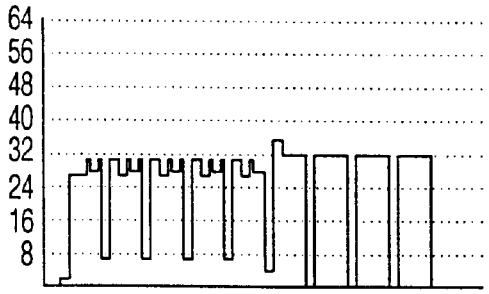
FIG. 7A
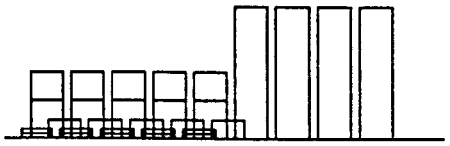
FIG. 7B
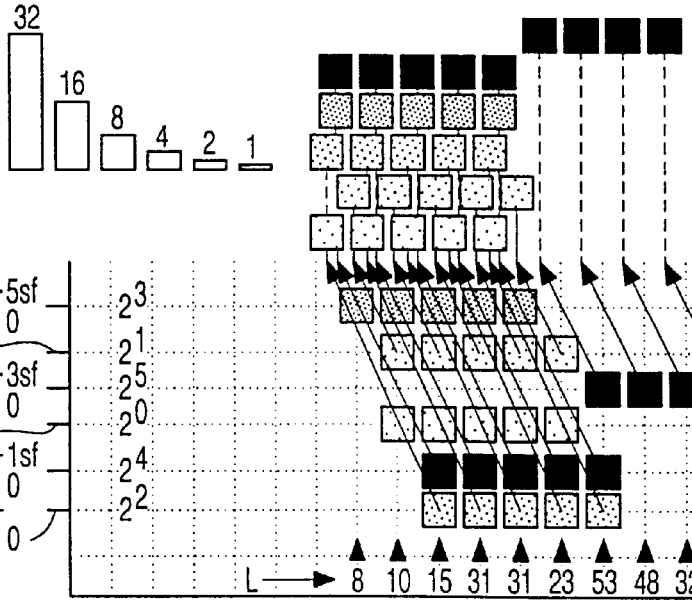
FIG. 7C
FIG. 7D

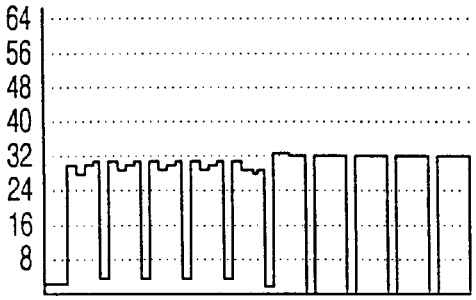
FIG. 8A
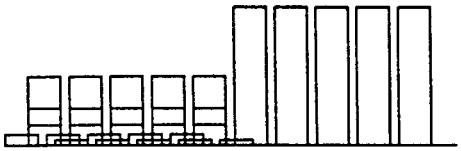
FIG. 8B
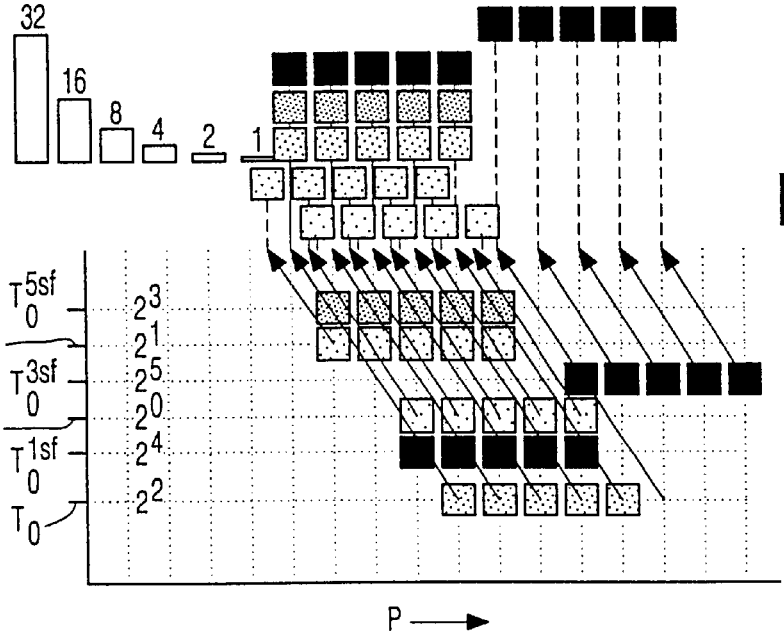
FIG. 8C
FIG. 8D

DISPLAY DRIVING

BACKGROUND OF THE INVENTION

Field of the Invention

The invention relates to driving a display such as a plasma display panel.

An (AC) plasma display panel (PDP) and a digital (micro-)mirror device (DMD) are bi-level displays with a memory function, i.e., pixels (picture elements) can only be turned on or off. In conventional PDPs, three phases can be distinguished; an erase sequence, an addressing sequence and a sustain sequence. In the first sequence, the memories of all pixels are cleared. To switch a pixel on, the second addressing phase is necessary. In such a phase, the pixels are addressed on a line at a time basis. The pixels that should turn on are conditioned in such a way, that they each turn on when a voltage is put across its electrodes. The conditioning is done for all pixels in a display that should be switched on. After the addressing phase, a third phase, the sustain phase, is required in which the luminance is generated. All pixels that were addressed, turn on as long as the sustain phase lasts. The sustain period is common for all pixels of a display, thus, during this sustain period, all pixels on the screen that were addressed are switched on simultaneously.

The field period is divided into several sub-fields each consisting of a sequence of erase, address and sustain. The grey-scale contribution of each sub-field is determined by varying the duration of the sustain phase, i.e., how long the pixels are switched on. The duration of the sustain phase is further denoted as the weight of a sub-field. The higher the weight of a sub-field, the higher the luminance of a pixel that is switched on during the sustain phase. The grey-scale itself is now generated in such a way that the luminance value is divided into several sub-fields in which the sub-fields have various weights, i.e., the duration of the sustain phase is proportional to a weight factor, thus, also, the luminance output is proportional to the same weight factor. The sub-fields can be started in two fashions; they can be equally divided over a field period, or they can start when the previous one is finished. The latter situation is shown in FIG. 1. In FIG. 1, a field period including six sub-fields SF1–SF6 is shown for a conventional PDP. Each sub-field SFi includes an erase period EP, an addressing period AP, and a sustain period SP. The length of the sustain period SP of a sub-field determines its impact on the output luminance. By combining the sub-fields (i.e., switching the sub-fields on or off), a grey-scale can be made.

FIGS. 2A–2D show the artifacts resulting from motion at a speed of 2 pixels per field period. FIG. 2D shows a Time vs. Position diagram in which the six sub-fields together forming a first field $T_0$ are shown on the vertical axis, and position P is shown on the horizontal axis. Increasing luminance values L are set out horizontally; these luminance values are built up in a digital manner by means of the various sub-fields having binary weights. FIG. 2C shows where the various sub-field informations are perceived as a result of the motion at 2 pixels per field period. FIG. 2B shows the luminance contributions of the individual sub-fields, in which the sub-field $T^{5sf}$ with the weight $2^5$=32 is shown as the largest pillar, and the sub-field $T^{0sf}$ with the weight $2^0$=1 is shown as the smallest pillar. FIG. 2A shows the resulting luminance on the retina, as well as a line R indicating the intended ramp. The difference between the intended ramp and the actually perceived luminance on the retina is a problem to be solved. It can be seen from FIG. 2A that the observed luminance can differ a lot from the actual still image data. This method calculates the precise position of the sub-fields and weights of the pixels under the assumption that the eye is tracking the motion according to the motion vectors. FIG. 2D shows a part of the black and white luminance ramp. In this time-position diagram, the motion vectors are drawn with a speed of 2 pixels per field period. The projections of the separate sub-fields are drawn on a diagram in which the luminance is drawn as a function of the position on the retina when the eye is perfectly tracking the motion with a speed of 2 pixels per field period. All luminances generated by the sub-fields that are received at the same positions on the retina are integrated resulting in a diagram in which the total luminance received by the retina has been drawn as a function of the position on the retina (this is shown in FIG. 2A). What can be seen is that the pattern on the retina still does not resemble the still image luminance ramp. There is still a bright vertical bar visible. This is the cause of contouring, there is only a slight change in luminance between two pixels which result in a perceptive bright or dark impression. What also can be seen is that there are gaps visible between the MSB sub-fields. These gaps are only visible from a close distance and are caused by the black matrix in between the pixels. From a greater distance these gaps are not visible any more which can also be said when the bright vertical line gets too small. What can be seen from this figure is, that it looks like the luminance contributions of the sub-fields are not projected on the same positions as the most significant sub-field weight. It is as if some sub-fields take positions in between the pixels which is, in practice, not possible due to the discrete character of the display. This phenomenon is also explained in [Mikoshiba2]. This is all due to the low-pass behavior of the eyes, which give the suggestion that all sub-fields are generated at the same time which is not true.

As known from the prior art, motion-compensation can help reducing the motion artifacts. In the Time vs. Position diagram of FIG. 3, compensation of a grey level of 20 is shown for two successive fields T0 and T1. OL indicates the observed luminance, OP indicates the original positions. Without motion and thus without motion-tracking by the eye, the values 4 and 16 are on top of each other and thus added: the correct luminance value of 20 is observed. When a vertical line with this grey level moves over the screen with a speed of 6 pixels per field period, a motion artifact is seen of two vertical lines with a luminance level of 16 and 4. So, with motion and thus with motion-tracking by the eye but without motion-compensation, two separate lines are observed: a 16-line and a 4-line. This problem could be solved by shifting the sub-field with a weight of 4 to the right to the position where this sub-field crosses the motion vector (the time at which this sub-field is generated). So, with motion-compensation, the 4-values are shifted to the 16-line, so that the motion-tracking eye again perceives the correct value of 20. When the luminance variations are determined by amplitude modulation as on a CRT, the luminance is generated on one position on the retina, and when this movement is being tracked, the same luminance is again generated on the same position on the retina. Since, on a plasma display, the grey-scale modulation is done on a sub-field basis, and this object needs to have the same luminance during tracking, it is required to generate these separate sub-fields on the projected motion vector. When doing this, it can be seen from FIG. 3 that no longer two vertical lines are observed on the motion vectors, but only one with a luminance of 20.

It can also be seen that to be able to do this, it is required to assign two vertical lines to two columns of pixels, i.e., one column is assigned the value 16 and the other gets the value 4. When inspecting one field of this image, two vertical lines are seen, but when the whole moving sequence is observed (and this sequence is tracked by our eyes), only one vertical line is seen. Thus, to compensate for the error introduced by the motion and the tracking of the eyes, a luminance of 20 must be shown as projected on the motion vector. Thus, by shifting the luminance level of 4 to the right to a position on the motion vector, the right luminance level of the vertical line is obtained, when this pattern has a speed of 6 pixels per field period to the right.

The same method can be used for a luminance ramp. To compensate for this pattern; the luminances that are required are the luminance levels shown on the motion vectors, i.e., the luminances of the pixels that are shown are the luminances of the compensation pattern. This is shown in FIG. 4, in which OL indicates the obtained luminance when tracking, as a result of putting not the desired ramp itself, but the compensation pattern CP on the display. Thus, the luminances of the pixels that are visible, are the luminances projected on the motion vectors when the eyes are tracking the motion of 6 pixels per field period. What can be seen from this figure is that, when inspecting one field of this sequence at one position, a dark luminance level of 2 is shown, as, in this case, not the tracked motion, but the luminance of the compensation pattern CP is observed.

So, motion-compensation could work, but there is a problem in doing this for an arbitrary speed, as illustrated in FIGS. 5A–5D for a luminance change from 31 to 32 which is moving to the left with a speed of 3 pixels per field period. On the boundary of this luminance change an artifact is still clearly visible. This can be explained as follows. When the plasma panel has 6 sub-fields equally divided over one field time, and there is a speed of 6 pixels per field period, this results in a speed of 1 pixel every sub-field. Thus, motion-compensation works almost perfectly since the sub-field weights can be shifted to subsequent neighbor pixels. So, the sub-fields are exactly located on the motion vector and the grid of the matrix display. With an arbitrary speed, this no longer holds, and it is necessary to map the sub-fields to pixels that are not exactly located on the motion vector, so that other some artifacts remain.

SUMMARY OF THE INVENTION

It is, inter alia, an object of the invention to provide an improved method of driving a display which results in less visible artifacts. To this end, a first aspect of the invention provides a method of driving a display. Further aspects of the invention provide a display driving device using the method and a display apparatus incorporating the display driving device.

In a method of driving a display in accordance with a primary aspect of the present invention, field information from a field of an image signal is distributed over a plurality of sub-fields, and a start time for each sub-field is generated in dependence upon motion.

These and other aspects of the invention will be apparent from and elucidated with reference to the embodiments described hereinafter.

BRIEF DESCRIPTION OF THE DRAWINGS

In the drawings:

FIGS. 6A–6D illustrate motion-compensation with an improved sub-field order and timing at a speed of 2 pixels per field period;

FIGS. 7A–7D illustrate motion-compensation with an improved sub-field order and timing at a speed of 3 pixels per field period;

FIGS. 8A–8D and FIG. 9 illustrate motion-compensation with an improved sub-field order and timing at a speed of 4 pixels per field period;

DESCRIPTION OF THE PREFERRED EMBODIMENTS

Figure 5A:
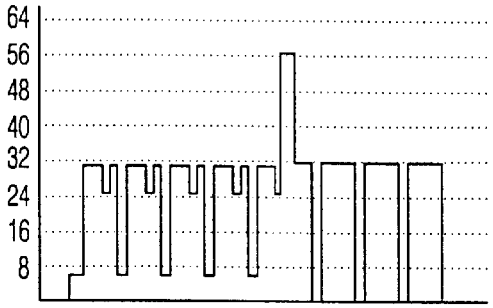
FIGS. 5A–5D illustrate motion-compensation at a speed of 3 pixels per field period.
Figure 5B:
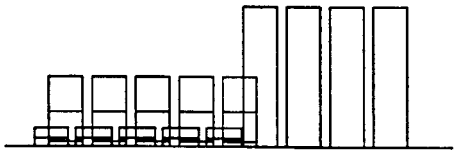
Figure 5C:
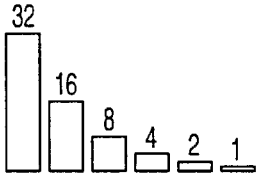
Figure 5D:
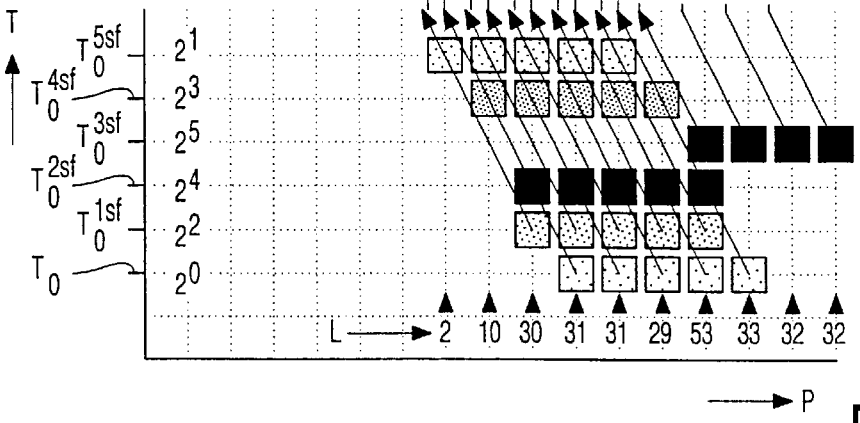

It was shown above how motion-compensation could reduce the motion artifacts and that it works well for a speed of 6 pixels per field period. It was also shown that for other speeds, still some artifacts remain. Hereinafter, it is shown how, in accordance with the present invention, the motion artifacts can be reduced even further by dynamically adapting the timing and sub-field order. Furthermore, when the sub-field timing and order is changed, the result of motion-compensation can be improved. In FIGS. 6A–6D, 7A–7D and 8A–8D this has been shown for another sub-field order and timing for a speed of 2, 3 and 4 pixels per field period. FIG. 7A shows a clear improvement over FIG. 5A.

Figure 9:
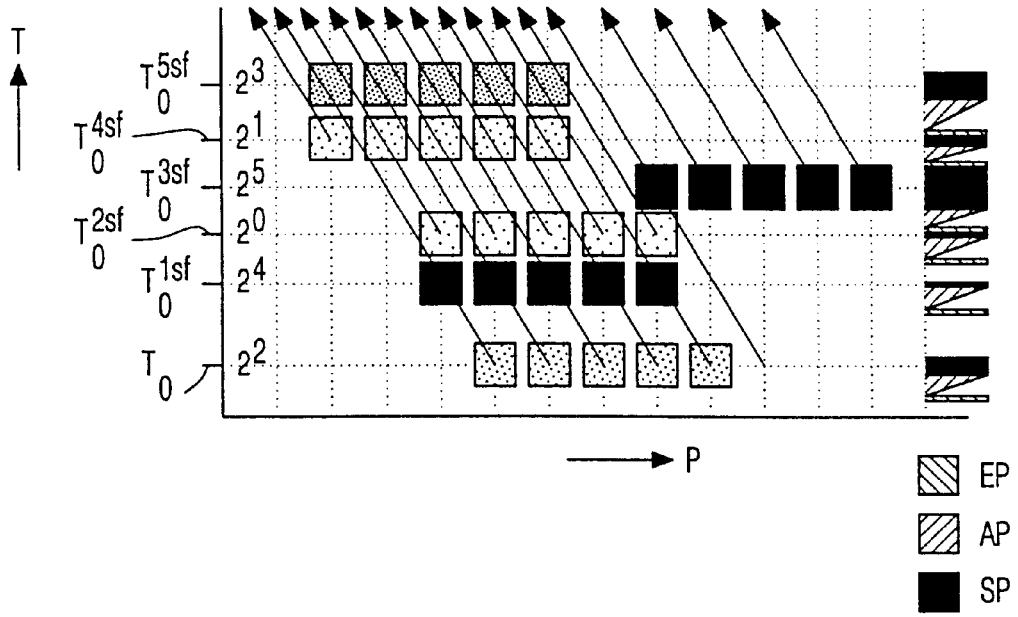

Two problems are encountered when trying to do this. First, the sub-field order and timing is fixed for a given display panel. Secondly, within a natural scene, more objects are visible with various speeds. The first problem can be overcome by letting the motion-compensation circuit be able to adapt the sub-field order and timing. The motion-compensation circuit could calculate (or a LUT with pre-programmed values could be used) the most optimum sub-field order and timing for a given speed. The sub-field timing is hereby determined by the compensation circuit and is not fixed any more. A preferred sub-field order and timing belonging to a speed of 4 pixels per field period from FIGS. 8A–8D is given in FIG. 9, in which at the right-hand side the sub-field order and timing is given. It can be seen that the field time is not completely utilized, which is clearly a disadvantage. But at this moment [Yamaguchi2] the motion artifacts are reduced by introducing more sub-fields for a given bit weight. Hereby is, for instance, one bit weight generated in two sub-fields, which requires an extra sub-field addressing and erase period (typically 1 ms duration). In some PDPs, this is pushed so far that it is at the cost of the number of inherent grey-levels per pixel. In a conventional PDP display, in principle, dual scan can be used to reduce the addressing time for an entire display, but at the cost of double the number of column drivers (40 ICs). The second problem is a fundamental problem, it hardly never occurs that there is only one speed apart from O in a natural scene. What mostly is the case is that only one speed within a certain small range is present much more often than any other speed. Furthermore, motion artifacts mostly occur around the most significant sub-fields (the sub-fields with the highest weights) at spatial sub-field changes when only a small change in grey-scale must be achieved. Both properties can be used to calculate the speed that shows most artifacts for that scene when a normal sub-field order would be used. This speed can be used as an input to calculate a more optimum sub-field timing and order. When implementing this in this way, flicker is likely to occur due to a sudden shift of a significant sub-field. (When a sub-field is suddenly shifted from timing, the time between the last occurrence of this sub-field and the present time can be, for instance, 25 ms which result in a flicker component of 40 Hz.) This can be diminished by not changing the sub-field timing at every change of the most optimum sub-field timing (thus low-pass filtering of the optimum speed for adjusting the optimum sub-field timing), and, secondly, not changing the sub-field timing suddenly, but in a slow fashion (slowly adjusting the timing of the most significant sub-fields until the optimum timing is obtained). In a preferred embodiment, this requirement is only present for the most significant sub-fields. Even when the optimum sub-field timing is not reached an improvement in motion portrayal can still be obtained.

In summary, a method is presented to reduce the motion artifacts by dynamically adapting the sub-field order and timing dependent on the contents of a video image. In the contents, the most common speed can be found whereby artifacts are likely to occur. At this speed, the best sub-field order and timing is calculated and this is applied in the panel. A Low-pass filtering this information prevents introduction of flicker due to sudden changes in sub-field timing.

More specifically, the speed to which the sub-field order is adjusted can be one of the following alternatives:

1. The most frequently occurring speed (simply derivable from the motion vectors);
2. Within the speed statistics, within a certain distribution of the speeds, an optimum can be found at which the artifacts are minimal;
3. The speed which causes most artifacts (derivable from the sub-field transitions between the pixels and the rounding errors with regard to the matrix grid in combination with the speed and sub-field timing);
4. The speed in the middle of the picture (most likely drawing most attention of the viewer);
5. A speed obtained in dependence on one or more of the above speeds by taking, e.g., an average or a median.

The artifact introduced depends on the grey level transitions between the pixels, the speed, and the specific sub-field timing and order (rounding errors with regard to the matrix grid). In allocating the most optimal sub-field timing, one could proceed in the following simple manner (this can be calculated once and stored in a LUT for all speeds):

1. Put the MSB sub-field (i.e., the sub-field having the highest sub-field weight) at a point of intersection between the matrix grid and a line indicating the motion vector (see FIG. 11, where the vertical lines indicate the matrix grid, and the diagonal line indicates the motion trajectory). Preferably, the MSB is put at a position close to the middle of that line to accommodate for motion-estimation errors.
2. Calculate the best position for the MSB-1 sub-field, keeping in mind that the sub-field having the highest but one weight introduces, in combination with the sub-field having the highest weight, most artifacts (gaps and overlaps). This calculation is carried out in accordance with the following formula:

$$\Delta t(x/v)*Tf,$$

in which

Δt is the time difference between the generation of the MSB-1 sub-field with reference to the MSB sub-field, x is the displacement expressed in full pixels, thereby reducing the rounding error to 0, and Tf is the field time.

Thereby, the displacement resulting in that both the MSB sub-field and the MSB-1 sub-field are on the same motion vector, has become an integer number of pixels. Stated in other words, the MSB-1 sub-field is put at another intersection (if present) of the matrix grid and the motion trajectory line of FIG. 11. If there is no second intersection between the matrix grid and the motion trajectory line, the MSB-1 sub-field is put on the matrix grid as close as possible to the motion trajectory line. Preferably, the MSB-1 sub-field is put at an intersection close to that of the MSB sub-field to reduce artifacts resulting from motion estimation errors. If there are several sub-fields having an identical highest weight, one of these sub-fields is taken for the above-mentioned MSB sub-field, while another of these sub-field is taken for the above-mentioned MSB-1 sub-field, etc.

3. Do the same as regards the other sub-fields: put them at an intersection between the matrix grid and the motion vector line, or put them on the matrix grid as close as possible to the motion trajectory line.
4. Finally, check whether all sub-fields have got a position. If not, shift the previous sub-fields a little bit so as to make room for the remaining sub-field or sub-fields, taking into account the minimum time required for each sub-field (sum of erase, address and sustain periods) and the need to reduce the position errors as much as possible.

Alternatively, it is possible to calculate for all speeds the optimum order and timing by calculating the smallest distance (i.e., positional error) to the motion vector, in which each sub-field is given a certain weight (not necessarily corresponding to the sub-field weight set out above). The smallest distance then corresponds to the smallest average error.

Figure 10:
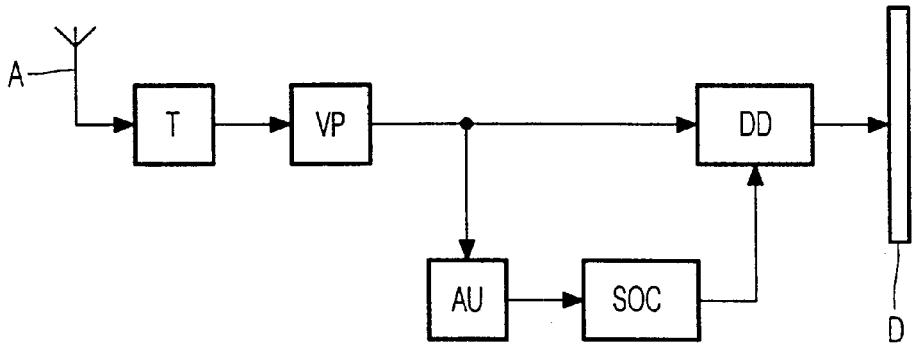
FIG. 10 shows a block circuit diagram of a display apparatus in accordance with the present invention.

FIG. 10 shows a block circuit diagram of a display apparatus in accordance with the present invention. An antenna A receives a television signal, which is applied to a tuner T. An output signal of the tuner T is applied to a video signal processor VP. An output signal of the video processor VP is applied to an analysis unit AU for analyzing speeds in an image and the contents of the image. An output signal of the analysis unit AU is applied to sub-field order and timing calculator SOC for calculating the most optimal sub-field order and timing in accordance with the present invention as described above. The output signal of the video processor VP is applied to a display driver DD, an output of which is connected to a PDP or DMD display D. A control input of the display driver DD is connected to an output of the sub-field order and timing calculator SOC for adjusting the sub-field order in accordance with the present invention. Preferably, the past is taken into account (low-pass filtering). Motion-compensation is based on the sub-field order and timing. This can have been stored into a LUT (look-up table) ROM.

Figure 1:
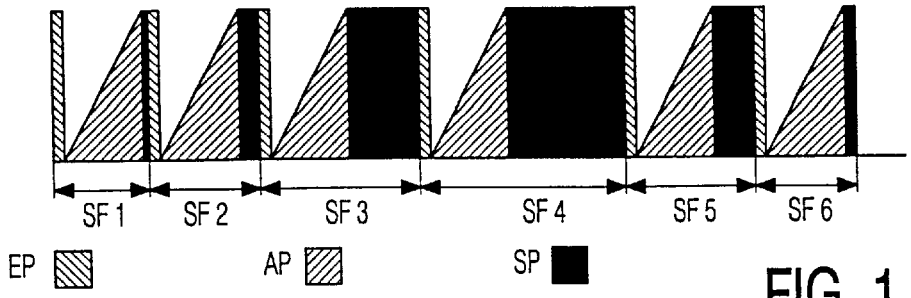
FIG. 1 illustrates an example of a field period for an AC plasma display.
Figure 2A:
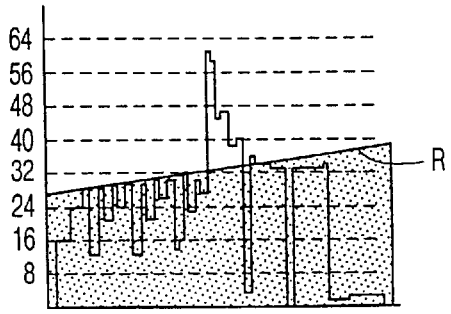
FIGS. 2A–2D illustrate motion artifacts for a luminance ramp at a speed of 2 pixels per field period.
Figure 2B:
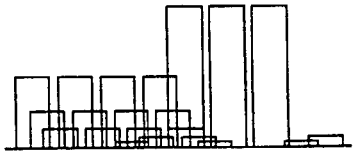
Figure 2C:
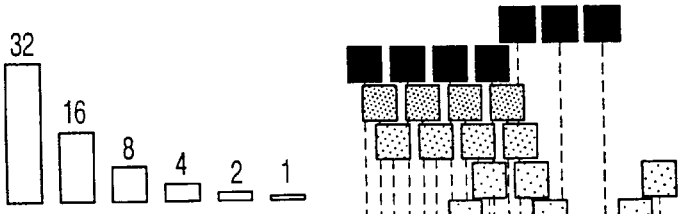
Figure 2D:
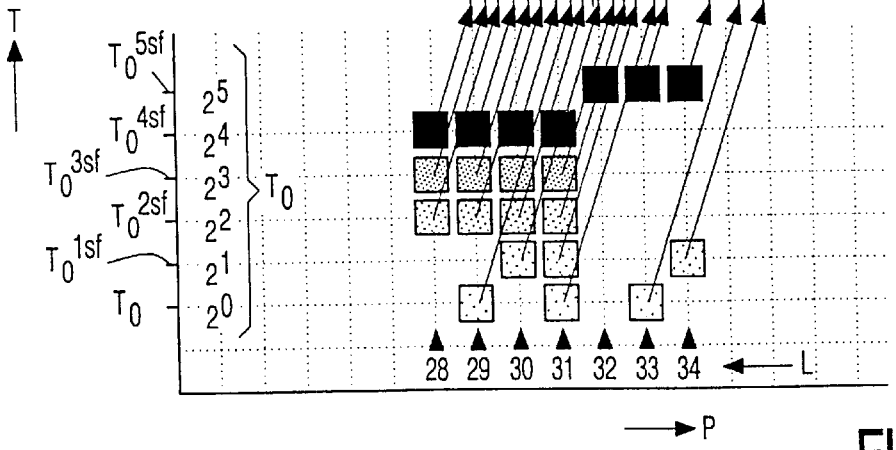
Figure 3:
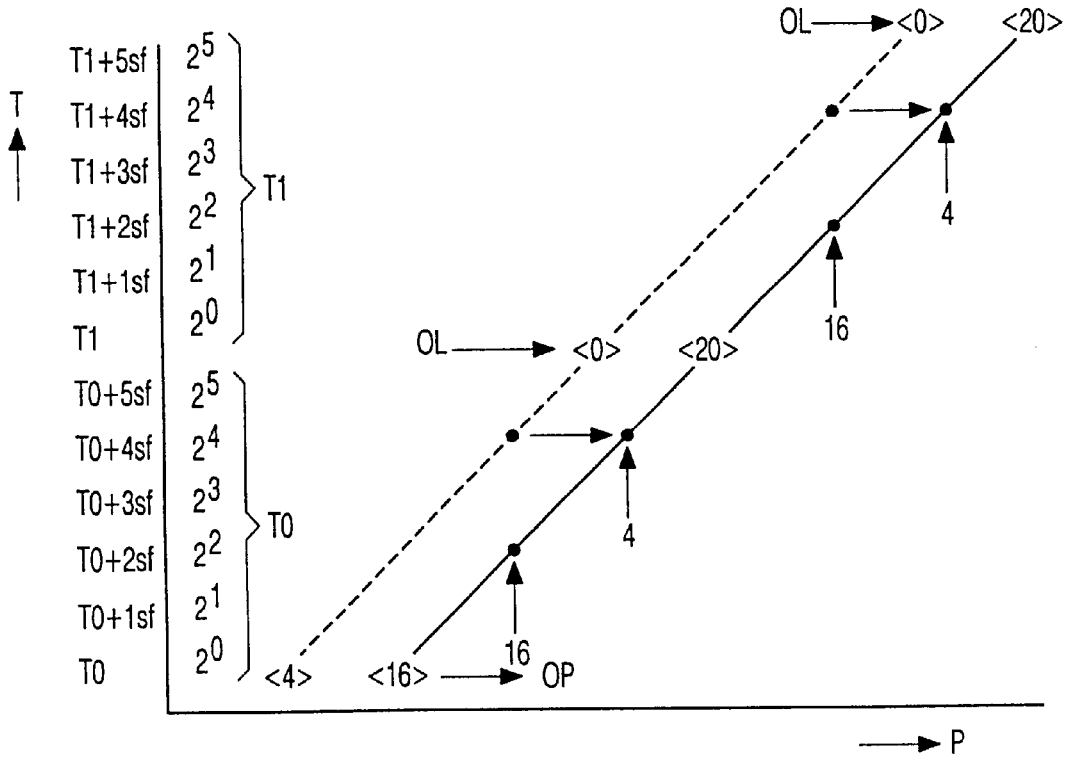
FIG. 3 illustrates motion-compensation of one grey-scale on the plasma screen.
Figure 4:
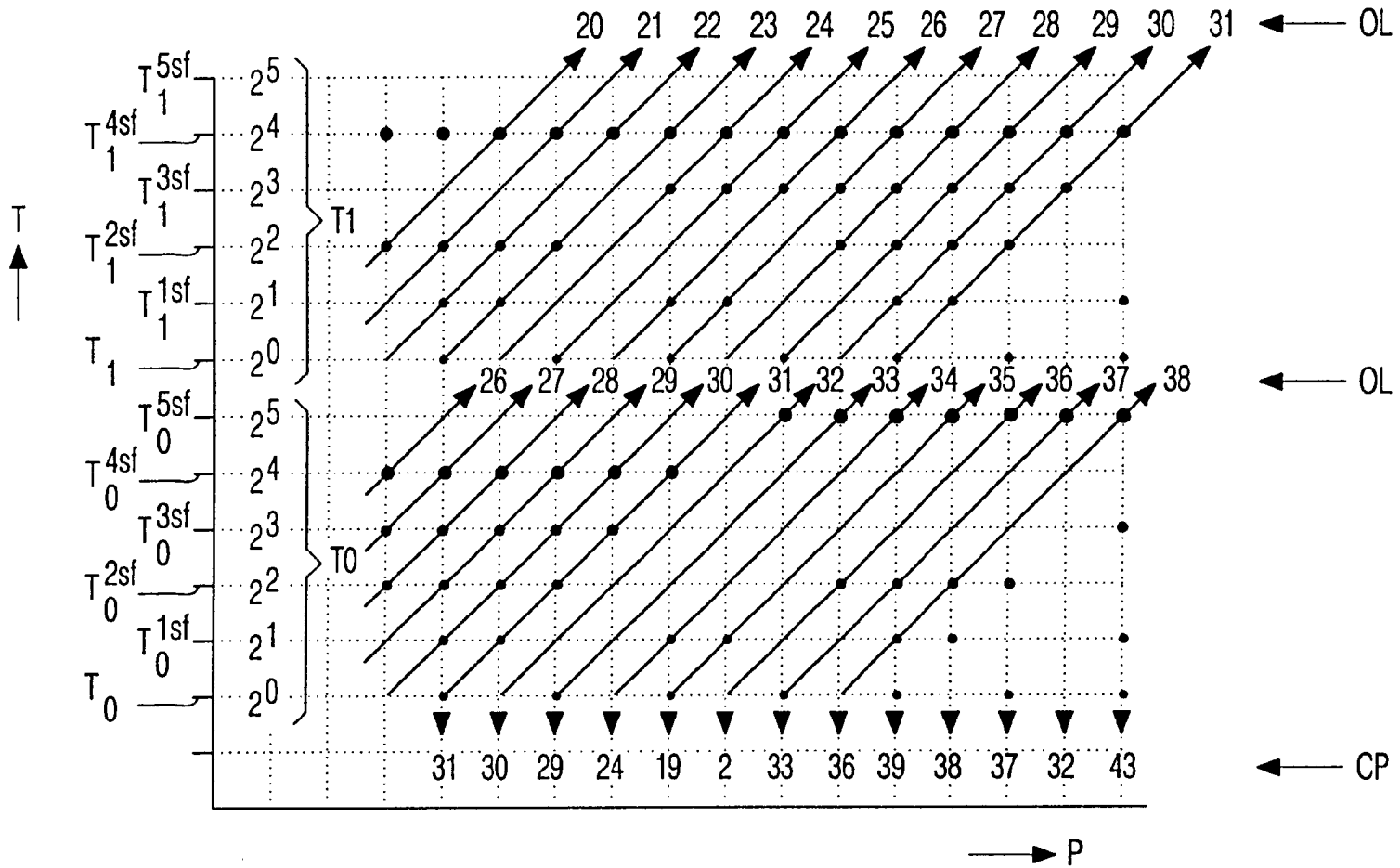
FIG. 4 illustrates a motion-compensated luminance ramp.
Figure 11:
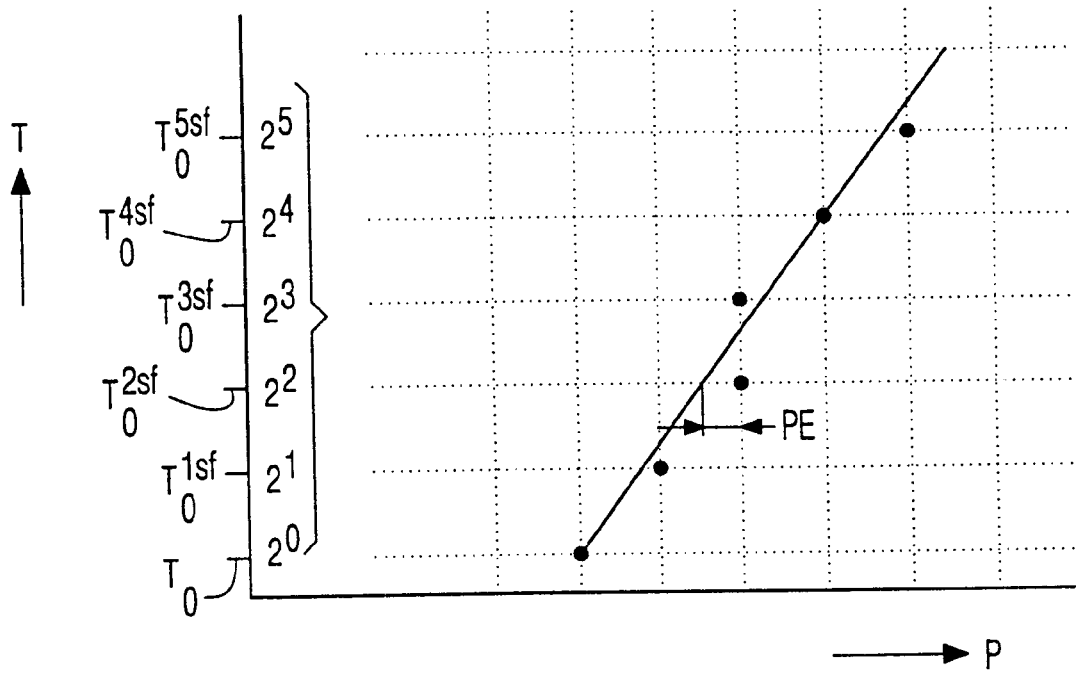
FIG. 11 explains the notion positional error.

FIG. 11 explains the notion positional error by means of a Time versus Position diagram of the type of FIG. 2D and other figures described above. The positional error PE mentioned above is the difference between the actual position (always an integer position) of a pixel in a sub-field on the display grid (indicated by a dot) on the one hand, and the line indicating the motion trajectory.

It should be noted that the above-mentioned embodiments illustrate rather than limit the invention, and that those skilled in the art will be able to design many alternative embodiments without departing from the scope of the appended claims. The invention can be implemented by means of hardware comprising several distinct elements, and by means of a suitably programmed computer. In the device claim enumerating several means, several of these means can be embodied by one and the same item of hardware. The motion-adaptive sub-field timing of the present invention can be combined with other techniques reducing motion-induced artifacts.

REFERENCED

[Mikoshiba] Mikoshiba, S., Dynamic False Contours on PDPs- Fatal or Curable?, IDW, 1996.

[Mikoshiba2] Mikoshiba, S. et al., Appearance of False Pixels and Degradation of Picture Quality in Matrix Displays having extended Light-Emission Periods, SID 92 Digest, 1992, pp. 659–662.

[Yamaguchi] Yamaguchi, T., et al. Degradation of moving image quality in PDPs: Dynamic False Contours, J. of the SID 4/4, 1996, pp. 263–270.

[Yamaguchi2] Yamaguchi, K. et al., Improvement in PDP picture quality by three-dimensional scattering of dynamic false contours, SID 96 Digest, 1996, pp. 291–294.

[Masuda] Masuda, T. et al., New Category Contour Noise observed in Pulse-Width-Modulated Moving Images, Internat.Display Res.Conf., 1994, pp. 357–360.

What is claimed is:

1. A method of driving a display, the method comprising the steps:

distributing field information from a field of an image signal over a plurality of sub-fields; and generating a start time for each sub-field in dependence upon motion in an image to be displayed of said image signal.

2. A method as claimed in claim 1, wherein said step of generating the sub-field start times in dependence upon motion includes the step:

generating a start time of the sub-fields in such a manner that the sub-fields lie on or as close as possible to intersections of a motion trajectory of the image to be displayed and a matrix grid of said display.

3. A method as claimed in claim 2, wherein in said generating step, first a sub-field having a highest weight among the sub-fields is positioned.

4. A method as claimed in claim 3, wherein said sub-field having said highest weight is position close to a middle of a line representing a motion vector of the image to be displayed on a grid defined by available positions on said display.

5. A method as claimed in claim 3, wherein a subsequent sub-field having said highest or a highest-but-one weight is positioned close to said sub-field having said highest weight.

6. A method as claimed in claim 1, wherein in said generating step, a sub-field timing is only gradually adjusted.

7. A device for driving a display, the device comprising:

means for distributing field information from a field of an image signal over a plurality of sub-fields; and means for generating a start time for each sub-field in dependence upon motion in an image to be displayed of said image signal.

8. A display apparatus, comprising:

means for furnishing an input image signal;

a display driving device as defined in claim 7; and a display for displaying the image signal.

* * * * *